US006966751B2

(12) United States Patent
Masterson et al.

(10) Patent No.: US 6,966,751 B2
(45) Date of Patent: Nov. 22, 2005

(54) TURBINE VIBRATOR

(75) Inventors: Michael J. Masterson, Bradford, IL (US); Terry L. Swearingen, Wyanet, IL (US)

(73) Assignee: Martin Engineering Company, Neponset, IL (US)

( * ) Notice: Subject to any disclaimer, the term of this patent is extended or adjusted under 35 U.S.C. 154(b) by 58 days.

(21) Appl. No.: 10/740,594

(22) Filed: Dec. 1, 2003

(65) Prior Publication Data

US 2005/0118015 A1 Jun. 2, 2005

(51) Int. Cl.[7] ..... F01D 5/28
(52) U.S. Cl. ..... 415/119; 415/202; 415/217.1
(58) Field of Search ..... 415/202, 217.1, 415/119; 366/124, 128

(56) References Cited

U.S. PATENT DOCUMENTS

| | | | | |
|---|---|---|---|---|
| 1,346,221 A * | 7/1920 | Liedtke | 366/124 |
| 2,818,184 A | 12/1957 | Matson | 366/124 |
| 2,960,316 A * | 11/1960 | Mckeller | 366/124 |
| 3,870,282 A | 3/1975 | Wadensten | 366/124 |
| 3,932,057 A | 1/1976 | Wadensten | 366/124 |
| 3,938,905 A * | 2/1976 | Wadensten | 415/202 |
| 4,604,029 A | 8/1986 | Fink | 415/92 |
| 5,314,305 A | 5/1994 | Fink | 415/202 |
| 6,244,815 B1 | 6/2001 | Treat | 415/54.1 |
| 6,261,059 B1 * | 7/2001 | Wadensten | 415/202 |
| 2001/0004438 A1 | 6/2001 | Reis | 415/202 |

* cited by examiner

*Primary Examiner*—Edward K. Look
*Assistant Examiner*—Richard A. Edgar
(74) *Attorney, Agent, or Firm*—Barnes & Thornburg LLP

(57) ABSTRACT

A turbine vibrator including a housing having a first end and a second end and a generally cylindrical internal surface forming a cylindrical central chamber. An end cap is attached to each end of the housing including one or more outlet ports in fluid communication with the central chamber. A turbine wheel is located within the central chamber of the housing and is rotatably supported by the end caps. The turbine wheel includes a central shaft, a cylindrical wall extending concentrically about the central shaft, and an eccentric weight extending between the shaft and the cylindrical wall. A rotor including a plurality of teeth formed from an elastomeric material extends around the cylindrical wall. A cap cover including one or more outlet ports is attached to each end cap with a muffler member disposed between the outlet ports in the end cap and the outlet ports in the cap cover.

30 Claims, 7 Drawing Sheets

TURBINE VIBRATOR

BACKGROUND

This disclosure is directed to a turbine vibrator having a rotatable turbine wheel located within a housing, and in particular to a turbine vibrator having gas outlet ports in end caps attached to the housing and wherein the turbine wheel includes a plurality of teeth formed from an elastomeric material, the teeth being located on a cylindrical wall that encloses an eccentric weight.

Turbine vibrators are often used to vibrate structures such as railroad hopper cars to facilitate the flow of bulk material from the structure. Turbine vibrators include a rotatable turbine wheel located in a housing. The turbine wheel typically includes an eccentric weight and a plurality of metal teeth. A compressed gas, such as air, is fed through an inlet in the housing such that the flowing air interacts with teeth of the turbine wheel and causes the turbine wheel to rotate about a rotational axis. The rotation of the eccentric weight of the turbine wheel about the rotational axis produces a vibrational force that is transmitted to whatever structure the turbine vibrator is attached. The interaction of the flowing air with the teeth of the turbine wheel, and the exhausting of the air from the housing, often creates a high level of undesired noise.

SUMMARY

A turbine vibrator including a housing and a turbine wheel. The housing includes a first end and a second end, a generally cylindrical internal surface extending between the first end and the second end forming a generally cylindrical central chamber, and an inlet port in fluid communication with the central chamber. A first end cap is attached to the first end of the housing and a second end cap is attached to the second end of the housing. The first end cap and the second end cap each include one or more outlet ports in fluid communication with the central chamber of the housing. The turbine wheel includes a central rotational axis and is located within the central chamber of the housing. The turbine wheel includes a shaft having a first end and a second end that extends concentrically along the central axis of the turbine wheel. The first end of the shaft is rotatably supported by the first end cap and the second end of the shaft is rotatably supported by the second end cap, such that the shaft is rotatable about the central axis. A generally cylindrical wall extends generally concentrically around the central axis and the shaft and is spaced apart from the shaft. The cylindrical wall forms an internal chamber. An eccentric weight is located within the internal chamber and is attached at one end to the shaft and at a second end to the cylindrical wall. The eccentric weight partially fills the internal chamber formed by the cylindrical wall. A rotor formed from an elastomeric material such as urethane extends around the exterior of the cylindrical wall. The rotor includes a plurality of teeth formed from the elastomeric material. A first cap cover is attached to the first end cap forming a first external chamber therebetween, and a second cap cover is attached to the second end cap forming a second external chamber therebetween. Each cap cover is formed from an elastomeric material such as urethane and includes one or more outlet ports in fluid communication with its external chamber. A muffler member such as a porous pad of polyurethane foam material is located in each external chamber.

BRIEF DESCRIPTION OF THE DRAWING FIGURES

DETAILED DESCRIPTION

Figure 1:
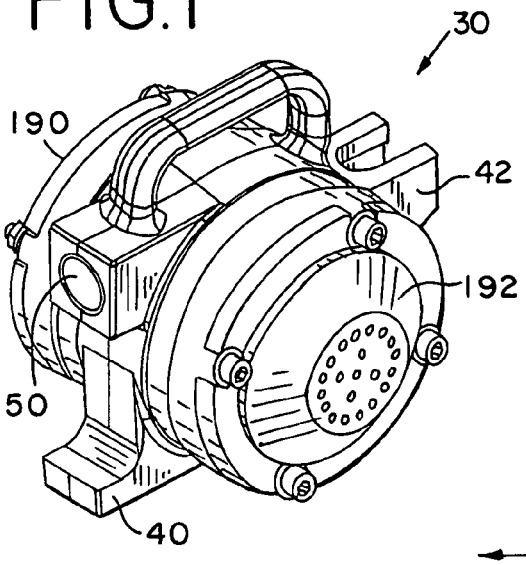
FIG. 1 is a perspective view of the turbine vibrator disclosed herein.
Figure 2:
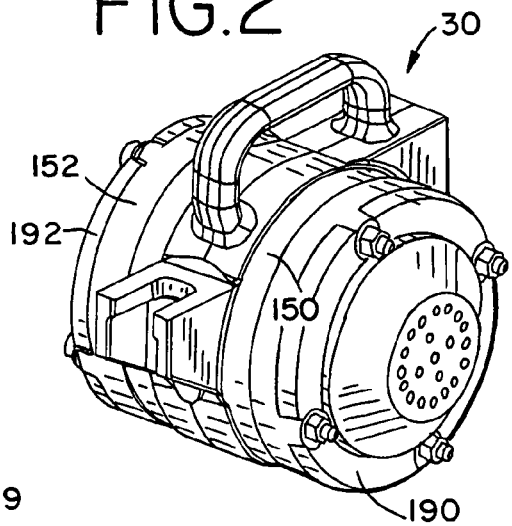
FIG. 2 is a perspective view of the opposite side of the turbine vibrator from that shown in FIG. 1.
Figure 3:
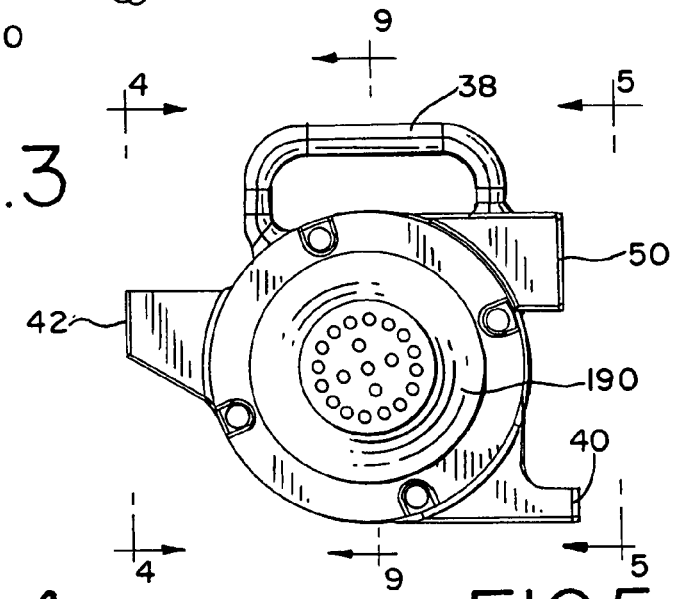
FIG. 3 is a side elevational view of the turbine vibrator.
Figure 4:
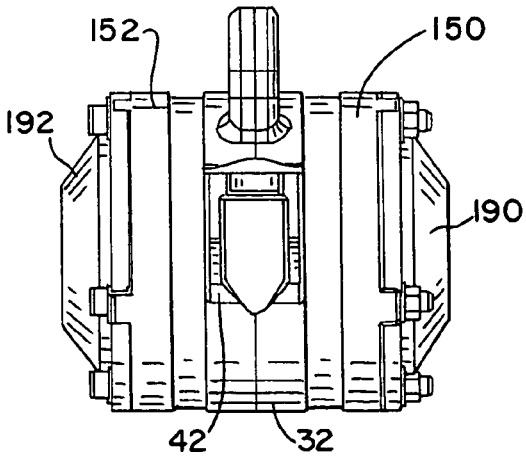
FIG. 4 is a rear elevational view taken along line 4—4 of FIG. 3.
Figure 5:
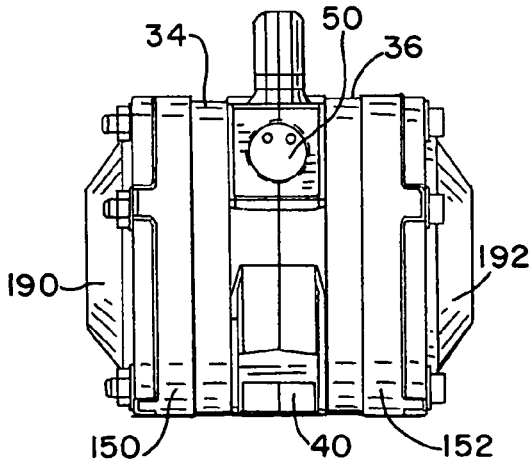
FIG. 5 is a front elevational view taken along line 5—5 of FIG. 3.
Figure 6:
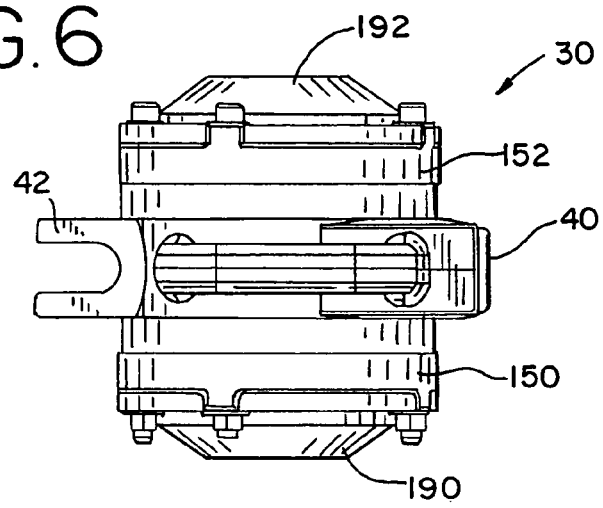
FIG. 6 is a top plan view of the turbine vibrator.
Figure 7:
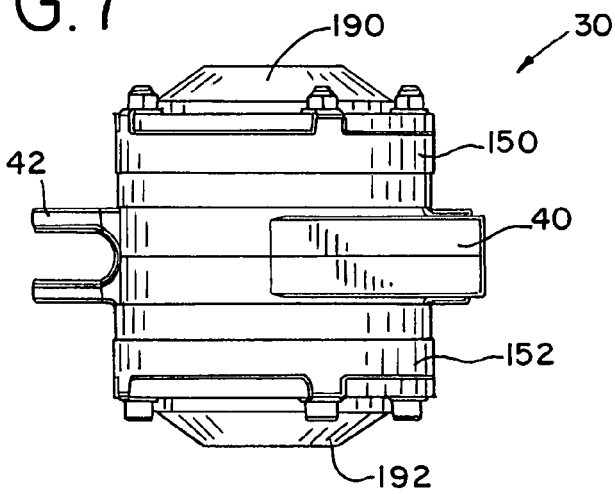
FIG. 7 is a bottom view of the turbine vibrator.

The turbine vibrator 30 includes a housing 32 that extends between a first end 34 and a second end 36. The housing 32 includes a handle 38 at the top of the housing 32 and a foot 40 at the bottom of the housing 32. The housing 32 also includes a generally U-shaped bracket 42. As shown in FIG. 3, the foot 40 and bracket 42 extend outwardly from the housing 32 in opposite directions relative to one another. The foot 40 and bracket 42 are adapted to facilitate selective attachment of the turbine vibrator 30 to a structure to be vibrated, such as a rail car. The foot 40 is adapted to be inserted into a receptacle on the structure to be vibrated, and the bracket 42 is adapted to receive a threaded rod having a nut adapted to releasably engage the bracket 42. The housing 32 may include alternate mounting arrangements other than the foot 40 and bracket 42 for removably attaching the vibrator 30 to a structure to be vibrated. For example, the housing 32 may alternatively include a flat foot with a bolt down base that can be selectively attached by fasteners to the structure to be vibrated, or the housing 32 may include a male wedge-shaped member adapted to be inserted into a female wedge-shaped bracket attached to the structure to be vibrated.

Figure 8:
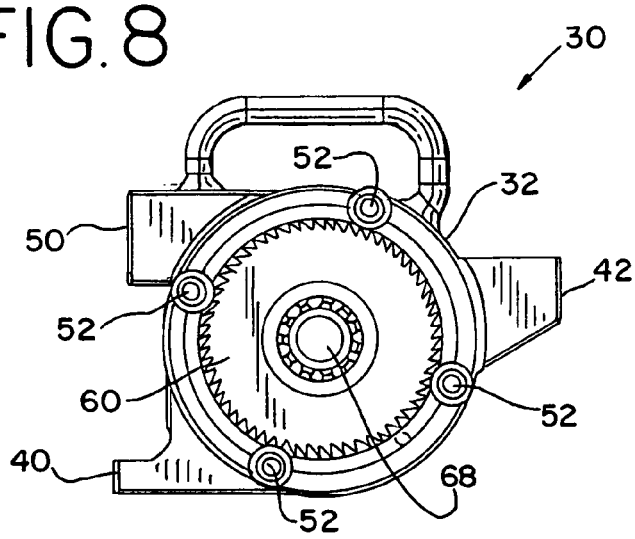
FIG. 8 is a side elevational view of the turbine vibrator with an end cap removed.
Figure 9:
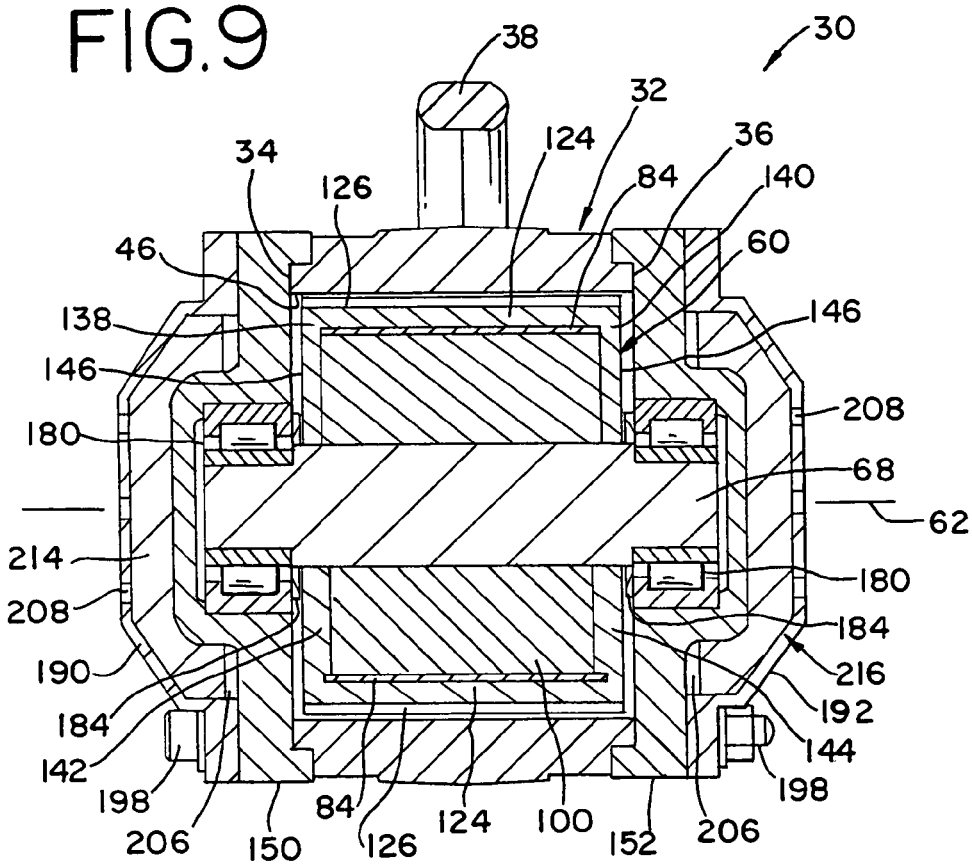
FIG. 9 is a cross sectional view taken along line 9—9 of FIG. 3.
Figure 10:
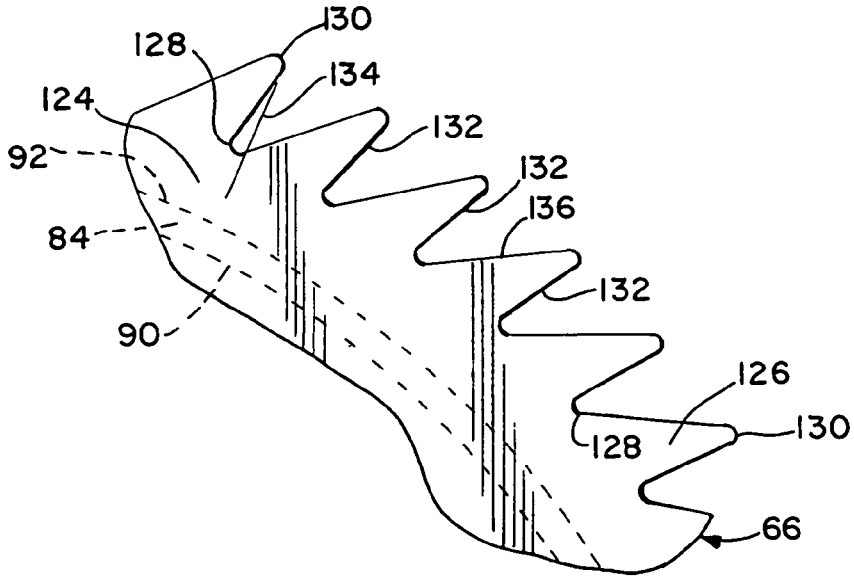
FIG. 10 is an enlarged partial view of the teeth of the turbine wheel.
Figure 11:
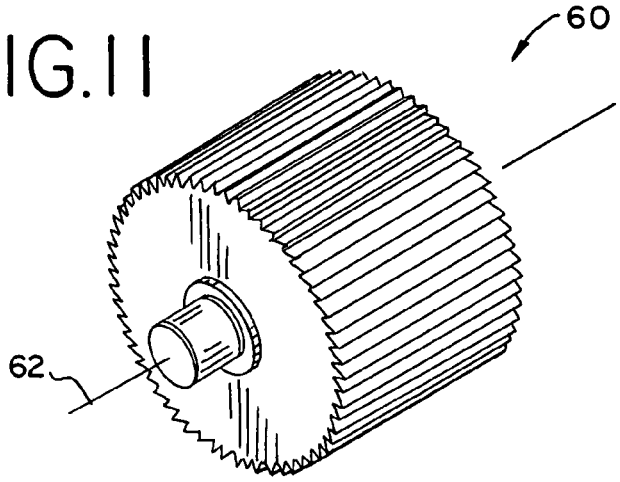
FIG. 11 is a perspective view of the turbine wheel.
Figure 12:
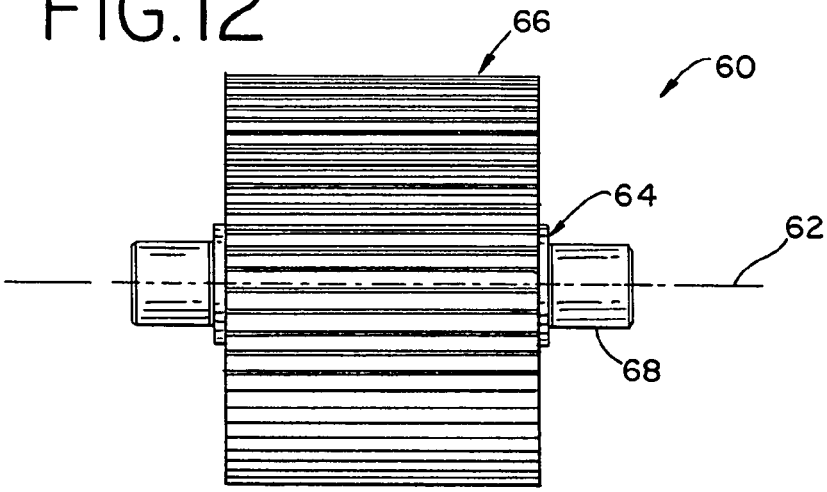
FIG. 12 is a front elevational view of the turbine wheel.

As shown in FIG. 9, the housing 32 includes a generally cylindrical internal surface 46 that extends from the first end 34 to the second end 36 of the housing 32. The cylindrical surface 46 forms a generally cylindrical central chamber 48 within the housing 32. The housing 32 also includes an inlet port 50 that it is fluid communication with the central chamber 48. The inlet port 50 is adapted to be removably connected to a supply of compressed gas, such as compressed air. Compressed air from inlet port 50 is fed into the central chamber 48 substantially tangential to the cylindrical surface 46. The first end 34 and second end 36 of the housing 32 each include a plurality of threaded bores 52 as shown in FIG. 8.

Figure 14:
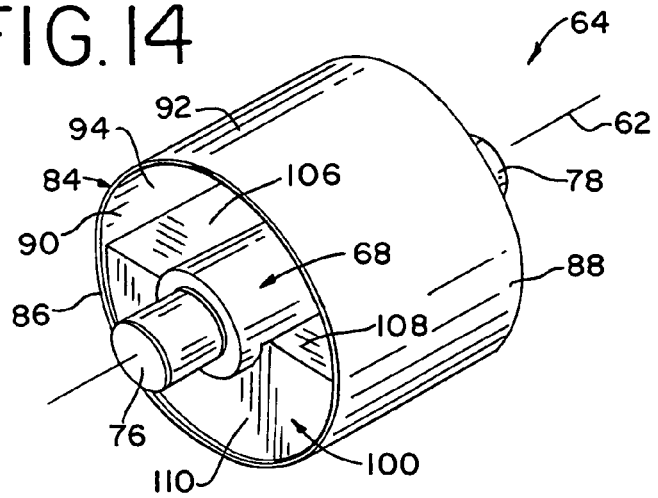
FIG. 14 is a perspective view of the hub of the turbine wheel.
Figure 15:
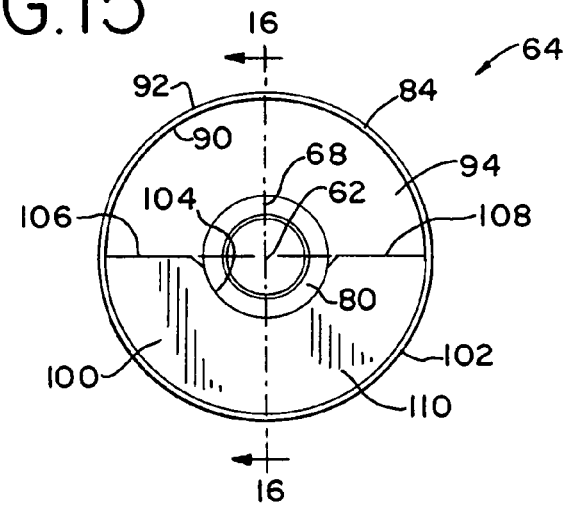
FIG. 15 is a side elevational of the hub.
Figure 16:
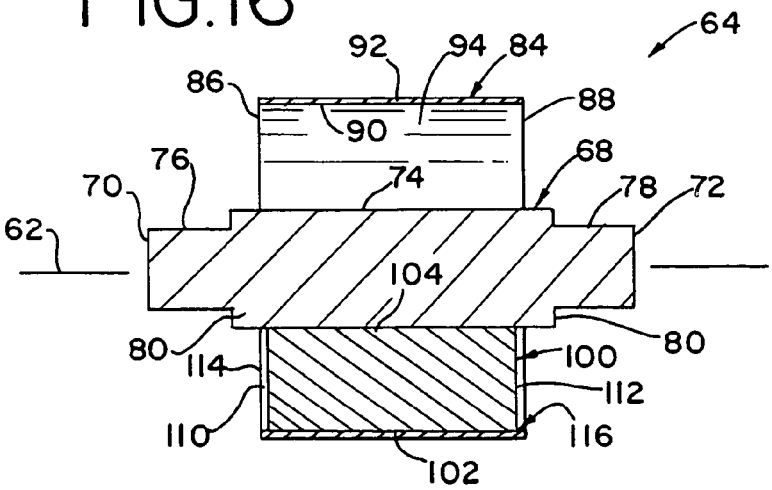
FIG. 16 is a cross sectional view taken along line 16—16 of FIG. 15.

The turbine vibrator 30 includes a turbine wheel 60 located within the central chamber 48 of the housing 32. The turbine wheel 60 includes a central axis 62 and is adapted to rotate about the central axis 62 with respect to the housing 32. The turbine wheel 60 includes a hub 64 and rotor 66. The hub 64, as shown in FIGS. 14–16, includes a shaft 68 having a first end 70 and a second 72. The central axis of the shaft 68 is coaxial with the central axis 62 of the turbine wheel 60. The shaft 68 includes a generally cylindrical center portion 74, a generally cylindrical first end portion 76, and a generally cylindrical second end portion 78. The center portion 74 and end portions 76 and 78 are each coaxially aligned along the central axis 62, with the first end portion 76 extending outwardly from a first end of the center portion 74 and the second end portion 78 extending outwardly from a second end of the center portion 74. The end portions 76 and 78 each have the same diameter, which is smaller than the diameter of the center portion 74. An annular wall 80 is formed between the center portion 74 and first end portion 76 and also between the center portion 74 and second end portion 78.

The hub 64 of the turbine wheel 60 also includes a generally cylindrical wall 84 having a generally circular edge 86 at a first end and a generally circular edge 88 at a second end. The cylindrical wall 84 includes a generally cylindrical interior surface 90 and a generally cylindrical exterior surface 92. The cylindrical wall 84 is located concentrically about the central axis 62 and is located concentrically around the shaft 68. The cylindrical wall 84 forms an internal chamber 94. The cylindrical wall 84 is spaced apart from the shaft 68. As shown in FIG. 16, the center portion 74 of the shaft 68 extends longitudinally outwardly beyond the circular edges 86 and 88 of the cylindrical wall 84.

The hub 64 of the turbine wheel 60 also includes an eccentric weight 100. The eccentric weight 100 includes an outer generally convexly curved surface 102 formed as a portion of a cylinder. The outer curved surface 102 is adapted to conform with and closely engage a portion of the interior surface 90 of the cylindrical wall 84. The eccentric weight 100 also includes an inner generally concavely curved surface 104 that is formed as a portion of a cylinder. The inner curved surface 104 is adapted to conform with and closely engage the outer surface of the center portion 74 of the shaft 68. The eccentric weight 100 includes a first end wall 106 that extends between a first end of the outer curved surface 102 and a first end of the inner curved surface 104. A second end wall 108 extends between a second end of the outer curved surface 102 and a second end of the inner curved surface 104. As shown in FIG. 15, the end walls 106 and 108 are generally planar and are generally coplanar with one another. The end walls 106 and 108 are located on opposite sides of the shaft 68 approximately 180° from one another about the central axis 62. Each end wall 106 and 108 extends from adjacent the shaft 68 to adjacent the interior surface 90 of the cylindrical wall 84 and extends generally radially with respect to the central axis 62.

The eccentric weight 100 also includes a planar first side wall 110 and a generally parallel and spaced apart planar second side wall 112. The side walls 110 and 112 extend between the curved surfaces 102 and 104 and the end walls 106 and 108. As shown in FIG. 16, the first side wall 110 is located generally parallel to the circular edge 86 of the cylindrical wall 84 and is spaced inwardly within the cylindrical wall 84 from the circular edge 86. Similarly, the second side wall 112 is located generally parallel to the circular edge 88 of the cylindrical wall 84 and is spaced inwardly within the cylindrical wall 84 from the circular edge 88. The cylindrical wall 84 forms a lip 114 between the first side wall 110 of the eccentric weight 100 and the circular edge 86 of the cylindrical wall 84. The cylindrical wall 84 forms a lip 116 between the second side wall 112 of the eccentric weight 100 and the circular edge 88 of the cylindrical wall 84. As shown in FIG. 15, the eccentric weight 100 partially fills the internal chamber 94 within the cylindrical wall 84. An outer end of the eccentric weight 100 is attached to the cylindrical wall 84, such as by one or more welds between the end walls 106 and 108 and the cylindrical wall 84. An inner end of the eccentric weight 100 is attached to the center portion 74 of the shaft 68, such as with one or more welds between the end walls 106 and 108 and the shaft 68. The eccentric weight 100 thereby connects the cylindrical wall 84 to the shaft 68.

As shown in FIG. 15, the eccentric weight 100 fills approximately one-half of the annular chamber formed between the shaft 68 and the cylindrical wall 84. If desired, the eccentric weight 100 can be formed to extend less than 180° around the central axis 62, such that the end walls 106 and 108 would be located at an angle of less than 180° with respect to one another, in order to reduce the total weight of the eccentric weight 100 and thereby reduce the vibrational force provided by the eccentric weight 100 when rotated about the central axis 62 at otherwise the same rotational speed. The shaft 68, cylindrical wall 84 and eccentric weight 100 may each be made from a metal, such as steel.

Figure 13:
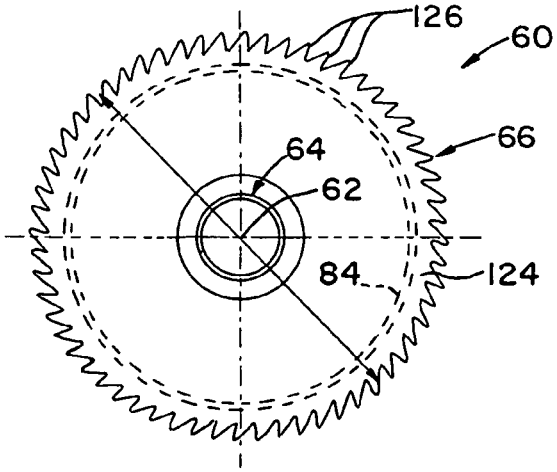
FIG. 13 is a side elevational view of the turbine wheel.

The rotor 66 of the turbine wheel 60, as shown in FIG. 13, includes a generally cylindrical base 124 that is attached to and that extends around and covers the external surface 92 of the cylindrical wall 84 of the hub 64. A plurality of teeth 126 extend outwardly from the base 124. Each tooth 126 extends generally linearly and parallel to the central axis 62. The teeth 126 are uniformly spaced apart from one another around the circumference of the cylindrical wall 84. Each tooth 126 extends from a curved root 128 to a curved tip 130. Each tooth 126 includes a first generally planar wall 132 that is located at an angle, such as at ten degrees, from a radial line 134 extending radially from the central axis 62, such that the tip 130 extends over a root 128. Each tooth 126 also includes a generally planar second wall 136 that extends from adjacent a root 128 to the tip 130. The second wall 136 of a first tooth 126 may be located at an angle of approximately thirty-six degrees to the first wall 132 of an adjacent second tooth 126. The tips 130 of adjacent teeth 126 are spaced apart from one another at an angle of approximately six degrees about the central axis 62. Each tooth 126 has a height from the root 128 to the tip 130 of approximately 0.232 inches. The tips 130 of the teeth 126 are generally located in a common circle at a common radius from the central axis 62.

The cylindrical base 124 of the rotor 66 includes a first generally circular end 138 and a second generally circular end 140. The rotor 66 includes a first side wall 142 that extends radially outwardly from the center portion 74 of the shaft 68 to the first end 138 of the base 124. A second side wall 144 extends radially outwardly from the center portion 74 of the shaft 68 to the second end 140 of the base 124. The side walls 142 and 144 enclose the internal chamber 94 within the cylindrical wall 84 and engage the first and second side walls 110 and 112 of the eccentric weight 100. Each side wall 142 and 144 includes a generally planar outer surface 146. The lips 114 and 116 of the cylindrical wall 84 extend respectively into the side walls 142 and 144. The cylindrical base 124, teeth 126, and side walls 142 and 144 of the rotor 66 may all be formed from a resilient elastomeric material, such as urethane or rubber. The urethane may have a durometer of 60 Shore D. The elastomeric material forming the rotor 66 is a light-weight low-density material compared to the material which forms the eccentric weight 100. Cast steel, that may form the eccentric weight 100, has a density of approximately 0.294 pounds per cubic inch. Urethane having a durometer of 60 Shore D, which may form the rotor 66, has a density of approximately 0.0469 pounds per cubic inch. The portion of the internal chamber 94 formed by the cylindrical wall 84 that is not filled by the eccentric weight 100 and the shaft 68, may remain substantially hollow or may be filled with a light-weight low-density material such as the elastomeric material that forms the rotor 66. The rotor 66 is molded onto the hub 64.

Figure 17:
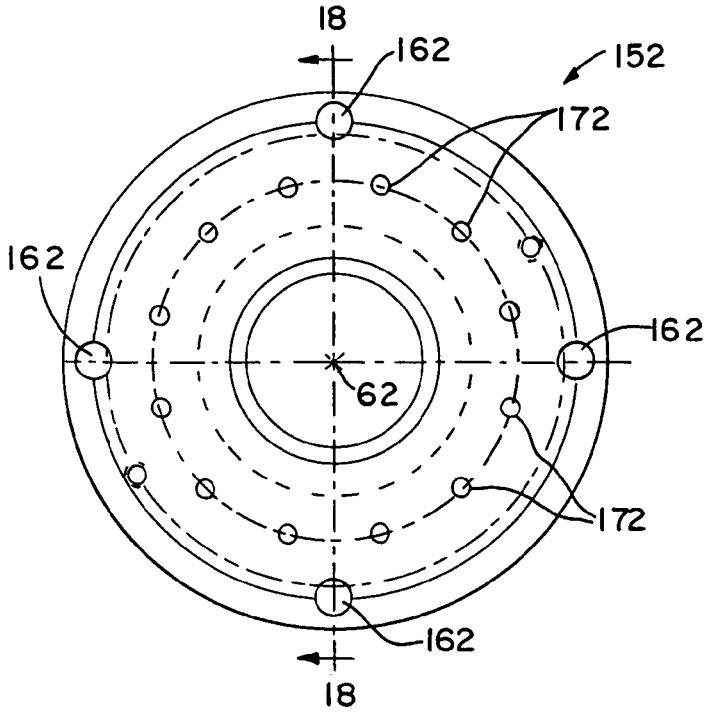
FIG. 17 is a side elevational view of an end cap.
Figure 18:
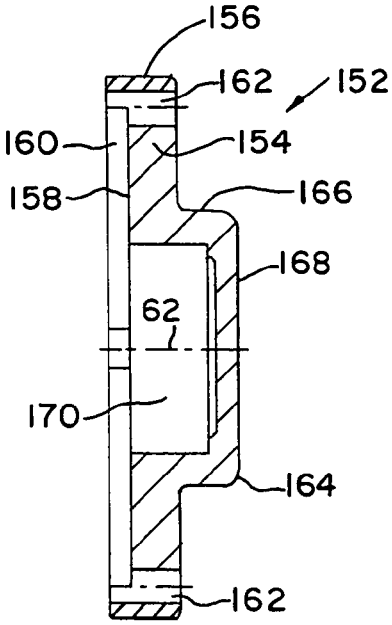
FIG. 18 is a cross sectional view taken along line 18—18 of FIG. 17.

The turbine vibrator 30 also includes a first end cap 150 and a second end cap 152. The end caps 150 and 152 are constructed and function identical to one another. As shown in FIGS. 17 and 18, the end cap 152 includes a generally annular flange 154 having a generally circular peripheral edge 156. The flange 154 includes a generally planar and annular interior surface 158 that is adapted to engage the second end 36 of the housing 32. A circular lip 160 extends outwardly from the internal surface 158 along the peripheral edge 156. The lip 160 forms a pocket adapted to receive the second end 36 of the housing 32. The flange 154 includes a plurality of bores 162 that are adapted to respectively align with the threaded bores 52 in the housing 32. A receptacle 164 having a generally cylindrical side wall 166 and a generally planar end wall 168 is concentrically attached to the exterior surface of the flange 154. The annular flange 154 and the cylindrical side wall 166 of the receptacle 164 form a pocket 170 located concentrically within the end cap. The end cap 152 also includes one or more outlet ports 172 that extend through the flange 154 from its internal surface to its external surface. The outlet ports 172 are located in a generally circular arrangement about the central axis of the end cap and are generally equally spaced apart from one another. As shown in FIG. 9, the first end cap 150 is removably attached to the first end 34 of the housing 32 and the second end cap 152 is removably attached to the second end 36 of the housing 32. The lip 160 of each end cap 150 and 152 engages a groove in the housing 32 to prevent transverse movement of the end caps with respect to the housing 32. The outlet ports 172 of the end caps 150 and 152 are in fluid communication with the central chamber 48 of the housing 32.

As shown in FIG. 9, a bearing assembly 180, including an inner race, an outer race and a plurality of bearings, is respectively located in each pocket 170 of the end caps 150 and 152. The turbine wheel 160 is located within the central chamber 48 of the housing 32 such that the end portions 76 and 78 of the shaft 68 are respectively coupled to a bearing assembly 180. The end portions 76 and 78 of the shaft 68 are thereby rotatably connected to and supported by the end caps 150 and 152 and the housing 32. The turbine wheel 60 is rotatable about the central axis 62 with respect to the housing 32 and end caps 150 and 152. There is a gap between the tips 130 of the teeth 126 of the turbine wheel 60 and the internal cylindrical surface 46 of the housing 32. This gap may be approximately 0.0375 inch, although a gap of a different size may be used if desired. A bushing 184 extends around the center portion 74 of the shaft 68 and is located between the first side wall 142 of the turbine wheel 60 and the bearing assembly 180 in the first end cap 150. A bushing 184 also extends around the center portion 74 of the shaft 68 and is located between the second side wall 144 of the turbine wheel 60 and the bearing assembly 180 located in the second end cap 152. The bushings 184 maintain a gap between the side walls 142 and 144 of the turbine wheel 60 and the internal surface 158 of the flange 154 of the end caps 150 and 152. The gap between the side walls 142 and 144 of the turbine wheel 60 and the internal surface 158 of the end caps 150 and 152 may be approximately 0.161 inch, although a gap of a different size may be used if desired. While the rotor 66 is formed from a resilient elastomeric material, the cylindrical wall 84 is very rigid to provide rigid support to the rotor 66 and thereby maintain the desired gaps between the turbine wheel 60 and the housing 32 and end caps 150 and 152.

Figure 19:
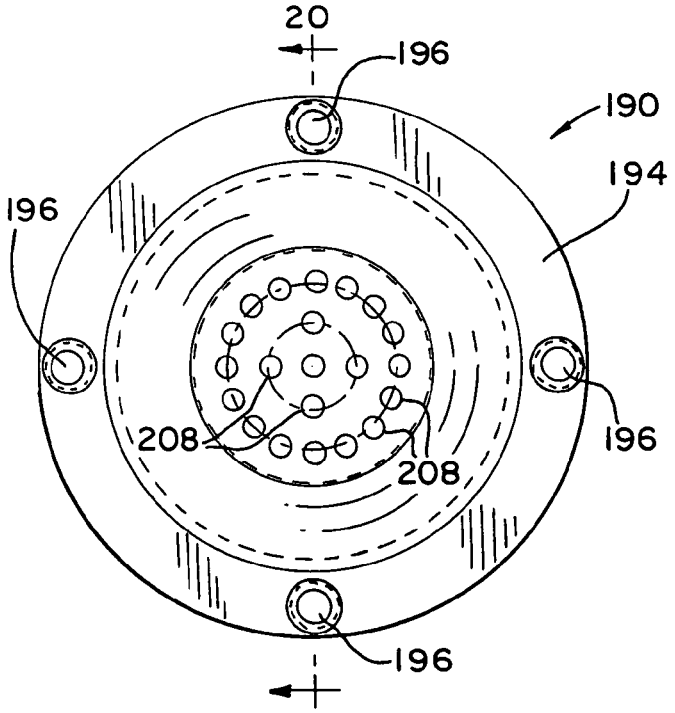
FIG. 19 is a side elevational view of a cap cover.
Figure 20:
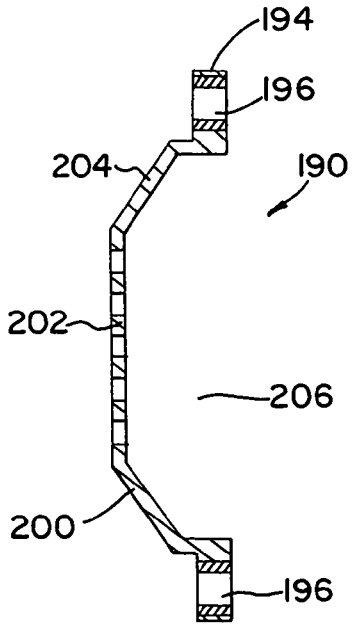
FIG. 20 is a cross sectional view taken along line 20—20 of FIG. 19.
Figure 21:
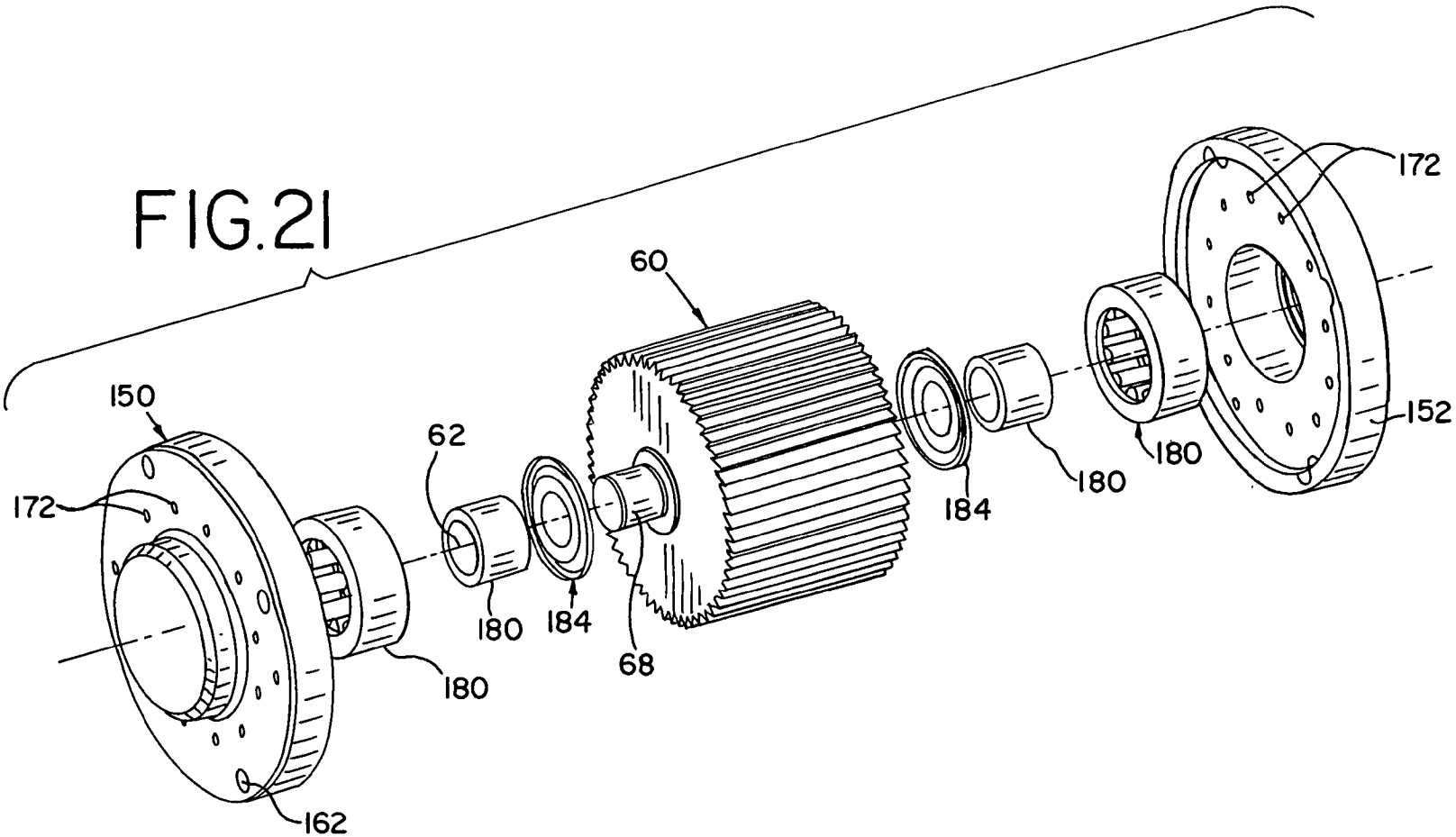
FIG. 21 is a partial exploded view of the turbine wheel and end caps.

The turbine vibrator 30 includes a first cap cover 190 and a second cap cover 192 that are constructed and function identical to one another. As shown in FIGS. 19 and 20, the first cap cover 190 includes a generally annular flange 194 including a plurality of bores 196. The bores 196 are adapted to be respectively aligned with the bores 162 in the end cap 150 and with the threaded bores 52 in the housing 32. Threaded fasteners 198, such as bolts, extend through the bores 196 and 162 and threadably engage the threaded bores 52 of the housing 32. The fasteners 198 thereby removably attach the end caps 150 and 152, and cap covers 190 and 192, to the housing 32. The cap cover 190 includes a generally concave dome 200 including a generally circular and planar central portion 202, and a generally conical portion 204 that extends between the central portion 202 and the flange 194. The dome 200 forms an external chamber 206 that is located between the first cap cover 190 and the first end cap 150. The external chamber 206 is in fluid communication with the outlet ports 172 in the first end cap 150 and with the central chamber 48 of the housing 32. The central portion 202 of the cap cover 190 includes one or more outlet ports 208. The outlet ports 208 are in fluid communication with the external chamber 206 and the atmosphere. As shown in FIG. 19, the outlet ports 208 are located in two concentric circles, and are equally spaced apart from one another in each circle. An outlet port 208 is also located at the center of the cap cover. The second cap cover 192 is similarly attached to the second end cap 152 forming an external chamber 206 in fluid communication with the outlet ports 172 in the second end cap 152. The cap covers 190 and 192 are formed from a resilient elastomeric material such as urethane or rubber.

The turbine vibrator 30 includes a first muffler member 214 and a second muffler member 216. The first muffler member 214 is located within the external chamber 206 formed between the first cap cover 190 and the first end cap 150 and is located between the outlet ports 172 of the first end cap 150 and the outlet ports 208 of the first cap cover 190. The second muffler member 216 is located within the external chamber 206 formed between the second cap cover 192 and the second end cap 152, and is located between the outlet ports 172 of the second end cap 152 and the outlet ports 208 of the second cap cover 192. The outlet ports 208 of the cap covers 190 and 192 are thereby in fluid communication with the outlet ports 172 of the end caps 150 and 152 through the respective muffler members 214 and 216. The muffler members 214 and 216 may be formed from a porous pad of foam material, such as polyurethane foam.

In operation, the turbine vibrator 30 is rigidly attached to the structure to be vibrated with the foot 40 and bracket 42. A supply of compressed gas, such as air, is connected to the inlet port 50. Compressed air flows from the inlet port 50 into the central chamber 48 of the housing 32 wherein the air engages the teeth 26 of the turbine wheel 60. The air within the central chamber 48 of the housing 32 flows between the side walls 142 and 144 of the turbine wheel 60 and the internal surface 158 of the end caps 150 and 152 to the outlet ports 172 in the end caps 150 and 152. The air flows through the outlet ports 172 in the end caps 150 and 152 into the external chambers 206 of the cap covers 190 and 192. The air flows from of the outlet ports 172 of the end caps 150 and 152 through the muffler members 214 and 216 and then through the outlet ports 208 in the cap covers 190 and 192 to the atmosphere.

As the air flows through the central chamber 48 of the housing 32, the air engages the teeth 126 of the turbine wheel 60 causing the turbine wheel 60 and the eccentric weight 100 to rotate about the central rotational axis 62. The rotation of the turbine wheel 60 and eccentric weight 100 about the central axis 62 with respect to the housing 32 creates a vibrational force that is transferred from the turbine vibrator 30 to the structure to be vibrated. The compressed air enters the central chamber 48 of the housing 32 in a direction generally transverse to the central axis 62 and exits the central chamber 48 at both ends 34 and 36 of the housing 32 through the outlet ports 172 in the end caps 150 and 152 in a direction generally parallel to the central axis 62. The passage of the air expelled from the central chamber 48 of the housing 32 through the outlet ports 172, muffler members 214 and 216, and outlet ports 208 substantially reduces the level of noise created by the air exhaust. In addition, the configuration of the teeth 126 of the turbine wheel 60, and the construction of the teeth 126 from a resilient elastomeric material, also reduces the level of noise from what is otherwise generated when the teeth 26 are formed from metal.

Various features of the invention have been particularly shown and described in connection with the illustrated embodiment of the invention, however, it must be understood that these particular arrangements merely illustrate, and that the invention is to be given its fullest interpretation within the terms of the appended claims.

What is claimed is:

1. A turbine vibrator including:

a housing having a first end and a second end, a generally cylindrical internal surface forming a central chamber, and an inlet port in fluid communication with said central chamber;

a turbine wheel located within said central chamber of said housing, said turbine wheel including a central axis, a shaft having a first end and a second end, said shaft being rotatably connected to said housing for rotation about said central axis, a generally cylindrical wall extending generally concentrically around said central axis and around said shaft, said cylindrical wall forming an internal chamber, said cylindrical wall attached to said shaft for conjoint rotation, an eccentric weight located within said internal chamber and partially filling said internal chamber, and a plurality of teeth extending outwardly away from said cylindrical wall, said teeth being formed from an elastomeric material;

whereby compressed gas is adapted to enter said central chamber of said housing through said inlet port, the gas causing said turbine wheel to rotate about said central axis with respect to said housing.

2. The turbine vibrator of claim 1 wherein said eccentric weight extends approximately one-hundred eighty degrees around said central axis.

3. The turbine vibrator of claim 1 wherein said eccentric weight extends less than one-hundred eighty degrees around said central axis.

4. The turbine vibrator of claim 1 wherein said eccentric weight includes a first end attached to said shaft and a second end attached to said cylindrical wall.

5. The turbine vibrator of claim 1 wherein said eccentric weight includes a first side wall spaced inwardly from a first edge of said cylindrical wall and a second side wall spaced inwardly from a second edge of said cylindrical wall.

6. The turbine vibrator of claim 1 wherein said turbine wheel includes a rotor, said rotor including a base and said plurality of teeth, said base extending around the periphery of said cylindrical wall, said plurality of teeth extending outwardly from said base of said rotor.

7. The turbine vibrator of claim 6 wherein said base of said rotor is formed from an elastomeric material.

8. The turbine vibrator of claim 1 wherein said elastomeric material is selected from the group consisting of urethane and rubber.

9. The turbine vibrator of claim 1 wherein said turbine wheel includes a first side wall enclosing a first end of said cylindrical wall and a second side wall enclosing a second end of said cylindrical wall.

10. The turbine vibrator of claim 9 wherein said first and second side walls are formed from an elastomeric material.

11. The turbine vibrator of claim 1 including a first end cap attached to said first end of said housing, said first end cap including one or more first outlet ports in fluid communication with said central chamber.

12. The turbine vibrator of claim 11 including a second end cap attached to said second end of housing, said second end cap including one or more outlet ports in fluid communication with said central chamber.

13. The turbine vibrator of claim 12 wherein said first end of said shaft is rotatably supported by said first end cap and said second end of said shaft is rotatably supported by said second end cap.

14. The turbine vibrator of claim 12 including a first cap cover attached to said first end cap and a second cap cover attached to said second end cap, said first cap cover forming a first external chamber with said first end cap, and said second cap cover forming a second external chamber with said second end cap, said first cap cover including one or more outlet ports in fluid communication with said first external chamber, and said second cap cover including one or more outlet ports in fluid communication with said second external chamber.

15. The turbine vibrator of claim 14 including a first muffler member located in said first external chamber and a second muffler member located in said second external chamber.

16. A turbine vibrator including:

a housing having a first end and a second end, a generally cylindrical internal surface forming a central chamber, and an inlet port in fluid communication with said central chamber; and a rotatable turbine wheel located within said central chamber of said housing, said turbine wheel including a central axis, an eccentric weight, and a generally cylindrical rotor having a plurality of teeth formed from an elastomeric material.

17. The turbine vibrator of claim 16 wherein said elastomeric material is selected from the group consisting of urethane and rubber.

18. The turbine vibrator of claim 16 wherein said teeth include a curved tip.

19. The turbine vibrator of claim 16 wherein said rotor includes a generally cylindrical base formed from an elastomeric material, said plurality of teeth extending outwardly from said base.

20. A method of making a turbine vibrator including the steps of:

providing a housing having a generally cylindrical internal surface forming a central chamber, and an inlet in fluid communication with said central chamber;

providing a shaft having a central axis;

attaching an eccentric weight to said shaft;

attaching a generally cylindrical wall to said eccentric weight such that said cylindrical wall is located generally concentrically about said central axis and such that said eccentric weight partially fills a chamber formed within said cylindrical wall;

positioning said shaft, said eccentric weight, and said cylindrical wall within said central chamber of said housing such that said eccentric weight is rotatable about said central axis with respect to said housing.

21. The method of claim 20 including the step of applying a plurality of teeth to an exterior surface of said cylindrical wall.

22. The method of claim 21 wherein said teeth are formed from an elastomeric material.

23. A turbine vibrator including:

a housing having a first end and a second end, a generally cylindrical internal surface forming a central chamber, and an inlet port in fluid communication with said central chamber;

a turbine wheel located within said central chamber of said housing, said turbine wheel including a central axis, a shaft having a first end and a second end, said shaft being rotatably connected to said housing for rotation about said central axis, a generally cylindrical wall extending generally concentrically around said central axis and around said shaft, said cylindrical wall forming an internal chamber, said cylindrical wall attached to said shaft for conjoint rotation, a first side wall enclosing a first end of said cylindrical wall, a second side wall enclosing a second end of said cylindrical wall, an eccentric weight located within said internal chamber and partially filling said internal chamber, and a plurality of teeth extending outwardly away from said cylindrical wall;

whereby compressed gas is adapted to enter said central chamber of said housing through said inlet port, the gas causing said turbine wheel to rotate about said central axis with respect to said housing.

24. The turbine vibrator of claim 23 wherein said turbine wheel includes a rotor extending around the periphery of said cylindrical wall, said rotor including said plurality of teeth.

25. The turbine vibrator of claim 24 wherein said rotor is formed from an elastomeric material.

26. The turbine vibrator of claim 23 wherein said first and second side walls of said turbine wheel are formed from an elastomeric material.

27. The turbine vibrator of claim 26 wherein said elastomeric material is selected from the group consisting of urethane and rubber.

28. A turbine vibrator including:

a housing having a first end and a second end, a generally cylindrical internal surface forming a central chamber, an inlet port in fluid communication with said central chamber, an end cap attached to said first end of said housing, said end cap including one or more outlet ports in fluid communication with said central chamber, a cap cover formed from an elastomeric material attached to said end cap, said cap cover forming an exterior chamber between said cap cover and said end cap, said outlet ports of said end cap being in fluid communication with said exterior chamber, said cap cover including one or more outlet ports in fluid communication with said exterior chamber;

a turbine wheel located within said central chamber of said housing, said turbine wheel including a central axis, a shaft having a first end and a second end, said shaft being rotatably connected to said housing for rotation about said central axis, an eccentric weight attached to said shaft for conjoint rotation, and a plurality of outwardly extending teeth;

whereby compressed gas is adapted to enter said central chamber of said housing through said inlet port, and gas within the central chamber is adapted to flow through said outlet ports of said end cap into said external chamber formed by said cap cover and to flow outwardly through said outlet ports of said cap cover, the gas causing said turbine wheel to rotate about said central axis with respect to said housing.

29. A turbine vibrator including:

a housing having a first end and a second end, a generally cylindrical internal surface forming a central chamber, an inlet port in fluid communication with said central chamber, an end cap attached to said first end of said housing, said end cap including one or more outlet ports in fluid communication with said central chamber, a cap cover attached to said end cap, said cap cover forming an exterior chamber between said cap cover and said end cap, said outlet ports of said end cap being in fluid communication with said exterior chamber, said cap cover including one or more outlet ports in fluid communication with said exterior chamber, and a muffler member formed from a porous foam material located in said external chamber;

a turbine wheel located within said central chamber of said housing, said turbine wheel including a central axis, a shaft having a first end and a second end, said shaft being rotatably connected to said housing for rotation about said central axis, an eccentric attached to said shaft for conjoint rotation, and a plurality of outwardly extending teeth;

whereby compressed gas is adapted to enter said central chamber of said housing through said inlet port, and gas within the central chamber is adapted to flow through said outlet ports of said end cap into said external chamber formed by said cap cover and to flow through said muffler member and outwardly through said outlet ports of said cap cover, the gas flowing through said central chamber of said housing causing said turbine wheel to rotate about said central axis with respect to said housing.

30. A turbine vibrator including:

a housing having a first end and a second end, a generally cylindrical internal surface forming a central chamber, and an inlet port in fluid communication with said central chamber;

a turbine wheel located within said central chamber of said housing, said turbine wheel including a central axis, a shaft having a first end and a second end, said shaft being rotatably connected to said housing for rotation about said central axis, a generally cylindrical wall extending generally concentrically around said central axis and around said shaft, said cylindrical wall forming an internal chamber, said cylindrical wall attached to said shaft for conjoint rotation, an eccentric weight located within said internal chamber, said internal chamber formed by said cylindrical wall being partially filled by said eccentric weight and by said shaft and the remainder of said internal chamber being substantially filled with a material having a lower density than the density of the material forming said eccentric weight, and a plurality of teeth extending outwardly away from said cylindrical wall;

whereby compressed gas is adapted to enter said central chamber of said housing through said inlet port, the gas causing said turbine wheel to rotate about said central axis with respect to said housing.

* * * * *